US005889876A

United States Patent [19]

Billings

[11] Patent Number: 5,889,876

[45] Date of Patent: Mar. 30, 1999

[54] HEMISPHERICAL SPEAKER SYSTEM

[76] Inventor: Bart P. Billings, 2704 Cazadero Dr., Carlsbad, Calif. 92009

[21] Appl. No.: 847,021

[22] Filed: May 1, 1997

[51] Int. Cl.[6] ..... H04R 25/00

[52] U.S. Cl. ..... 381/342; 381/182; 381/386; 181/144

[58] Field of Search ..... 381/24, 182, 186, 381/188, 156, 205, 87, 88, 89, 90, 300, 332, 335, 336, 342, 345, 386, 387, 151, 165; 181/144, 147, 150, 152, 153, 159, 199, 195

[56] References Cited

U.S. PATENT DOCUMENTS 4,673,057 6/1987 Glassco ..... 181/144
4,890,689 1/1990 Smith ..... 181/144
5,025,473 6/1991 Carlsen, II et al. ..... 381/88

*Primary Examiner*—Huyen Le
*Attorney, Agent, or Firm*—Baker & Maxham

[57] ABSTRACT

A speaker system of a plurality of speakers in a hemispherically directed array, includes a housing having a front, a back and a chamber, the back defined by a plane, and the front defined by a plurality of horns, each horn having a hyperboloid configuration and equally spaced around and from one another in a hemispherical array and directed outward from a common point on the plane, and each of the horns having an apex and a focal point, and a transducer of a first frequency range mounted at the apex thereof. An alternative includes a transducer of a higher frequency mounted at the focal point thereof.

20 Claims, 2 Drawing Sheets

HEMISPHERICAL SPEAKER SYSTEM

BACKGROUND OF THE INVENTION

The present invention relates to speakers and pertains particularly to an improved hemispherically directed speaker system.

The typical prior art reproduction or sound reproduction system typically comprises two housings or cabinets, usually containing multiple speakers located a distance apart at one end of a listening room. This arrangement is very directional and requires the listener to be positioned at a proper distance from the arrangement along a line normal to a base line through the two cabinets in order for a balanced sound.

A variation of this arrangement includes four speakers or cabinets positioned at the four corners of the room to provide what is commonly referred to as "surround sound". Again, this requires that the listener be at a particular location within the room for optimal balanced sound. Attempts to overcome some of these problems have involved the provision of special speaker arrangements positioned for reflecting the sound off of walls of the room towards the listener. These various arrangements, however, provide for improvement in quality of the sound at specific locations within the room, but with deterioration or dead spaces at other areas within the room.

Recent developments providing a divergent or omnidirectional speaker system have been proposed by Glassco, U.S. Pat. No. 4,673,057 granted Jun. 16, 1987, and Smith U.S. Pat. No. 4,890,689 granted Jan. 2, 1990, assigned to the Assignee hereof. These patents disclose an omnidirectional speaker system wherein a plurality of speakers are mounted in a housing and arranged to direct sound omnidirectionally outwardly from a common point centrally of the housing. That system was a considerable improvement over systems that existed at the time. It provides greatly improved sound reproduction for larger rooms and areas such as concert halls, auditoriums and arenas. Among the major advantages is that it reduced and substantially eliminated the highly directional effect of conventional speakers. It also substantially eliminated the problem of dead spots and other nuisances of conventional systems.

While these are a considerable improvement over the prior art existing at the time, they have draw-backs for certain installations. For example, there are many situations where omnidirectional speakers cannot be conveniently placed at the center of a room. This is particularly a problem for small rooms, lounges and the like. It is also desirable in some instances for the speaker system to be mounted on the musical instrument.

While smaller versions of the above system can be used in smaller buildings such as homes and offices, there is a need for a speaker system that can accommodate in smaller settings and on musical instruments for example.

SUMMARY AND OBJECTS OF THE INVENTION

A speaker system of a plurality of speakers in a hemispherically directed array, comprises a housing having a front, a back and a chamber, the back defined by a plane, and the front defined by a plurality of horns, each horn equally spaced around and from one another in a hemispherical array and directed outward from a common point on said plane, and each of said horns having an apex and a focal point, and a transducer mounted at the apex thereof. A variation includes a transducer of a first frequency at the apex, and a transducer of a higher frequency mounted at the focal point thereof.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENTS

Figure 1:
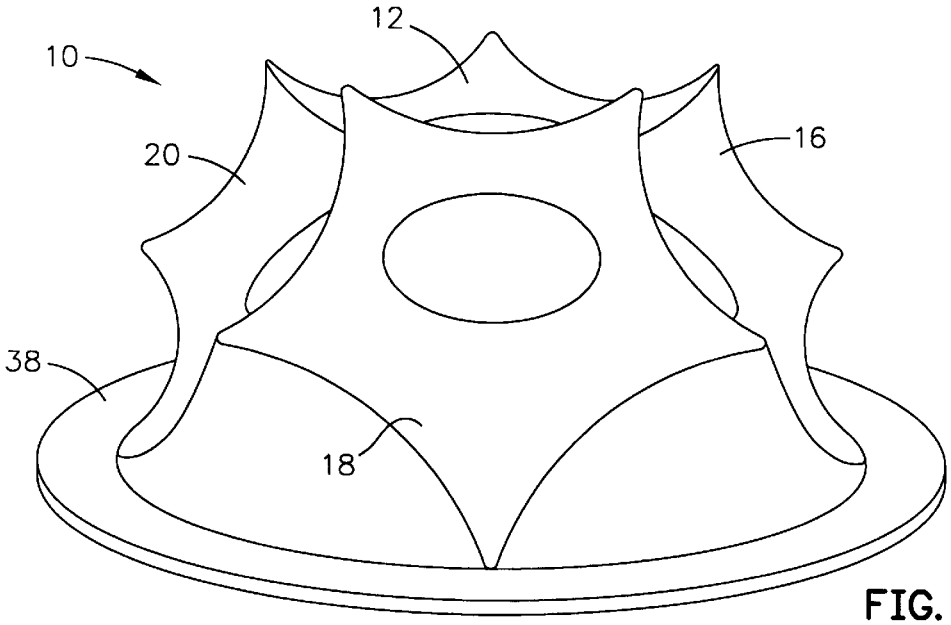
FIG. 1 is a perspective view illustrating a preferred embodiment of the present invention.

Referring to FIG. 1 of the drawings, a perspective view of an exemplary embodiment of a speaker system or unit in accordance with the invention is illustrated and designated generally by the numeral 10. The speaker system comprises a plurality of axially aligned sets or pairs of transducers, arranged within an enclosure to achieve a wide band width and high frequency along with hemispherically directed output. The pairs of transducers are geometrically arranged co-axially within each of a plurality hyperboloids of two sheets forming the face of the housing or enclosure. Each speaker is placed at the end of a long hyperboloid horn.

Figure 2:
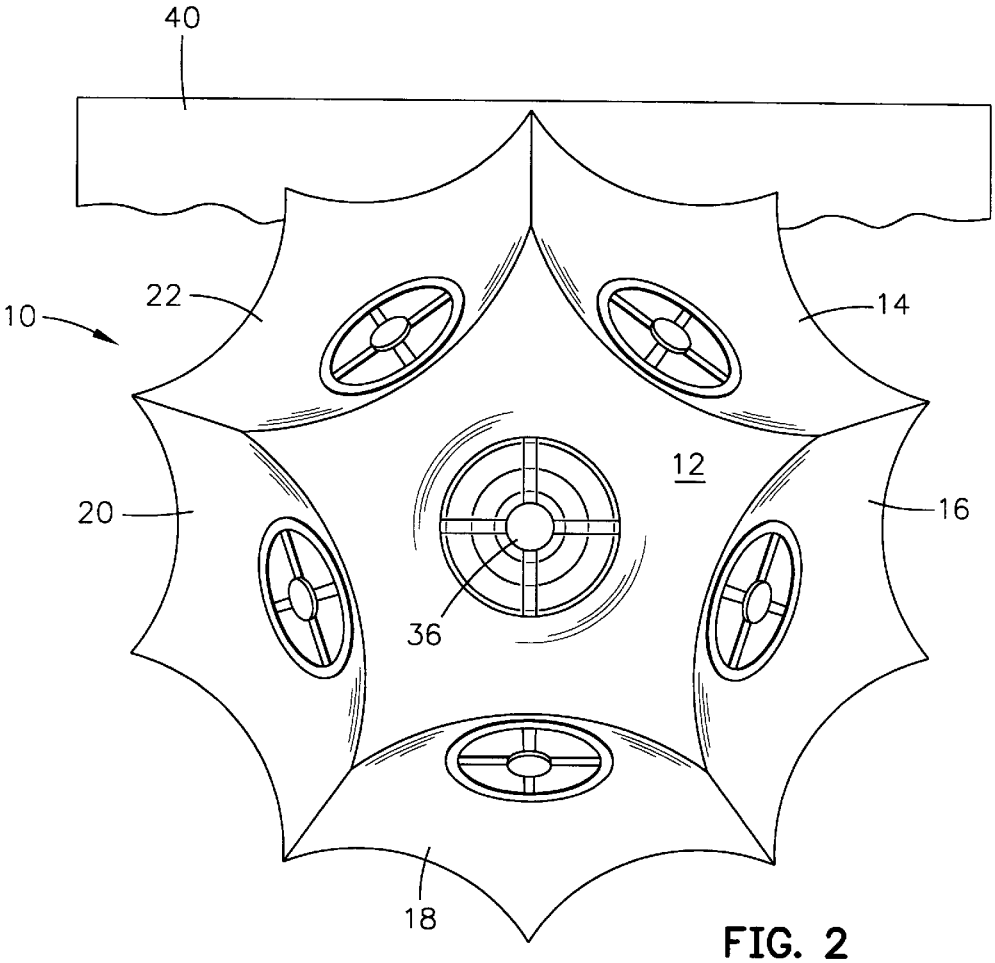
FIG. 2 is a front elevation view of the embodiment of FIG. 1.

The system, as illustrated in FIGS. 1 and 2, takes the shape of a one-half of dodecahedron with six hyperboloid horns forming the face, with the plurality of speakers forming or directed outwardly in a hemispherical array. Each of the six hyperboloid shaped faces contains a transducer or speaker mounted directly at its end and directed outward from the face. In many cases this may be a single full range speaker. In another arrangement (when not using a full range speaker or wolfer), a low frequency speaker is mounted at the apex of the hyperboloid surface, and a tweeter or high frequency speaker is mounted at the focal point of the hyperboloid.

The housing of the system is closed and sealed as in an acoustic type of suspension system. The six transducers or speakers of the system are electrically connected in phase so that they all move in unison or as one. The effect of this connection is that all cones or diaphragms move either inwardly or outwardly together, causing an increased or decreased internal pressure within the housing or enclosure, creating in effect a single speaker unit having a hemispherical sound distribution.

This provides a system that has some of the properties of the acoustic suspension system in that it exhibits a very flat frequency response, but with a high efficiency compared to the acoustic suspension system. The high efficiency is due to the inherent dynamic impedance, matching that comes from the use of the pressure waves of the six uniformally positioned adjacent transducers. The transducers are arranged to form a six-sided pressure wall, which expands exponentially away from the surface of the base or back of the housing. Additional efficiency is achieved by the hyperboloid faces or horns within which the transducers are each mounted.

This basic configuration provides an almost infinite baffle or matching horn. The curved shape of the speaker cone is extended to and intersects adjacent horns by a raised edge around the hyperboloid pentagon faces. This forms a point at the intersection of adjacent faces to eliminate turbulence between the adjacent speakers and forms an almost infinite extension of the hyperboloid horn by the pressure wave from adjacent horns.

The illustrated speaker array provides a unit that sufficiently conforms to the desired hyperboloid configuration to achieve high efficiency in sound reproduction. However, a more accurate conformance can be achieved by increasing the number of speakers up to about fifteen or so.

Figure 4:
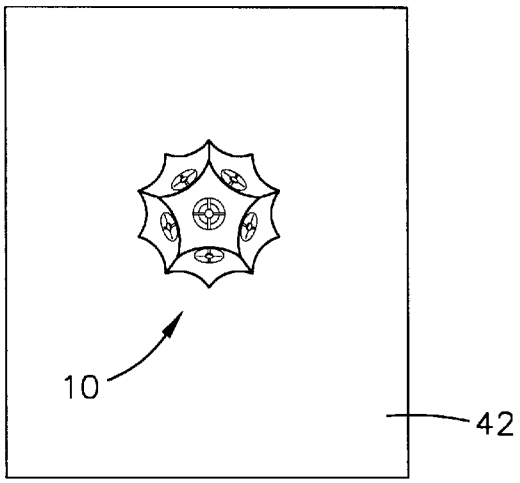
FIG. 4 is a plan view of a room showing an exemplary positioning of a speaker in accordance with the invention.

The enclosed hemispherical system is in effect an acoustic hemisphere, which is changing in volume at the applied audio voltage rate. The sound radiating from this hemisphere is truly hemispherically directed from a planar surface and causes an acoustic pressure change rather than a directed sound. This is particularly true within an enclosure, such as a room 42 or 44 or an auditorium for example. One or a single unit positioned in a room 42, as shown in FIG. 4 gives the impression of filling the room with music or sound. Cancelling and distortion, which is a problem of the prior art system, is essentially eliminated by this system with a single unit.

Referring specifically to FIGS. 1 and 2 of the drawings, the speaker system comprises a plurality of transducer units, designated generally by the numerals 12 through 22, on what is designated the front or face of the unit. The overall geometric configuration of the unit is such that the speakers are directed uniformly outwardly from a common point on a planar surface in a hemispherical direction. As shown in FIG. 1, the planar surface which forms the back of the enclosure can be a circular planar mounting plate 38. This forms one wall of the enclosure and provides a plate for mounting to other surfaces or structures.

The speaker unit as shown in FIG. 2 is closed with a rectangular panel 40 which may be a surface such as the top or bottom surface of a piano or other musical instrument. It can also be mounted on a front of a piano or other such instrument. The sound from the instrument would radiate out within a hemispherical direction. As can be seen from FIGS. 1 and 2, the speaker horns 14–22 each have an axis radiating outwardly from a common point of equal angles from one another and from central speaker horn 12.

The surfaces 12–22 are all formed of hyperboloid configuration, with each face properly configured and angularly spaced equally from its adjacent unit. The surface geometry is defined by the hyperboloid formula:

$$\frac{z^2}{c^2} - \frac{x^2}{a^2} - \frac{y^2}{b^2} = 1.$$

The pressure waves from adjacent speakers create and form a continuation of these hyperboloid horns or cones extending out into space.

Referring to FIGS. 1 and 2, it can be appreciated from the illustration that all speakers in each unit extend or are directed radially outward from a common point along axes that are at equal angles to one another. The speakers, therefore, radiate radially outward from a common center point on planar surface, for example within a hemisphere. The speaker transducer pairs are spaced along a common axis. The unit is ideally suited for mounting on an planar surface such as a wall, floor or ceiling of a room. It can also be mounted on a musical instrument, particularly on a planar surface of a piano.

Figure 3:
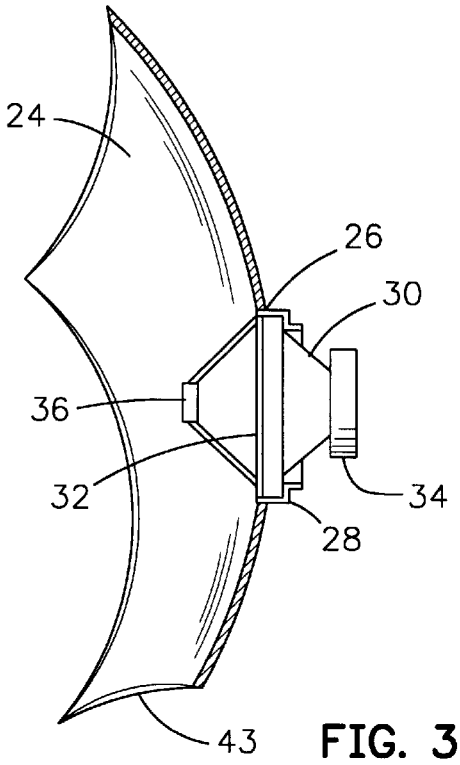
FIG. 3 is a side elevation view in section of a horn and transducer of the embodiment of FIG. 1.

With reference to the drawings, particularly to FIGS. 1, 2 and 3, one of the transducer units will be described, with it to be understood that they are identical. The transducer to be described will be that of numeral 12 which, as can be seen, comprises a generally pentagon shaped hyperboloid dish 24 having a circular aperture 26 disposed in the very center thereof. The dish 24 has a hyperboloid configuration, and may have a different degree of extension (i.e. length), but preferably extends out to merge with an adjacent cone at a very low angle. Each of the dishes has a mounting rim or flange 28 within or encircling the center opening or aperture 26 for receiving the edge of a speaker unit, as shown in FIG. 3.

The speaker unit comprises an outer frame or support frame 30, with a diaphragm or cone 32 extending across the face thereof. The diaphragm for this transducer is positioned at the back wall or apex of the hyperboloid dish and connected in the usual manner to voice coils, which are contained within and surrounded by a magnet 34. This may be a substantially full range speaker, and the speaker is selected and the entire enclosure sized and conformed to the power and characteristics of the speaker itself.

As an alternative this speaker 32 may be a base or low frequency range speaker. A tweeter 36 is then positioned forward of the base at the focal point of the hyperboloid dish or horn so that the sound from the tweeter is reflected over the entire surface of the hyperboloid. Each tweeter will then reflect its energy evenly throughout ⅙ part of total space.

The hyperboloid dish 24 (FIGS. 3 and 4) may be constructed of any suitable material, such as a hard plastic, wood, metal or other suitable material. The dish 24 forms a hyperboloid extension of the speaker cone as will be subsequently explained.

The pentagon shaped dishes are of a somewhat thin, rigid structure in the illustrated embodiment (FIG. 3) and is formed of a hyperboloid pentagon configuration, having scalloped shaped sides joining like scalloped or shaped sides of adjacent speaker units so that they converge or merge smoothly into the adjacent horn, preferably at a small angle of less than about fifteen degrees. This shape and construction provides an improved impedance match of the speaker on into the atmosphere.

Each of these scalloped sides may include a flange, as seen in FIG. 3, extending slightly outward to provide a mating surface for adjacent dishes. The dish edges form points which serve to accommodate the extension of the dish or horn function thereof and also reduce turbulence between adjacent speakers.

The combination of units, as illustrated in FIG. 3, makes up the entire system, as shown in FIGS. 1 and 2, and essentially form the face housing or enclosure in which the speaker or transducer units are each mounted. The back or base of the enclosure is planar and may be formed as a circular plate 38 as illustrated in FIG. 1. The back of the housing may also be formed as a larger rectangular panel 40, part of which is shown in FIG. 2 and may form a top, side or bottom wall of a piano. The units can be sized for the application such as the room or the like.

Referring to FIG. 4, one suitable application is shown wherein the speaker unit 10 is mounted on a ceiling or floor 42 of a room. The speaker unit is preferably placed at the center of the room whether on the ceiling or floor for a more uniform distribution of the sound. It can also be mounted under a balcony, such as in a theater.

Figure 5:
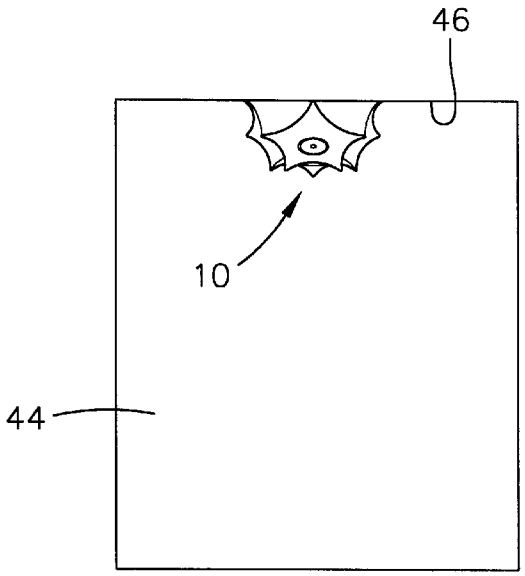
FIG. 5 is a plan view of a room showing an alternate positioning of a speaker in accordance with the invention.

Referring to FIG. 5, another arrangement within a room is shown wherein the speaker unit 10 is mounted in a room 44 on a wall 46. The sound radiates out uniformly from the speaker in a hemispherical direction.

The enclosure, as pointed out above, which is sealed such that the speaker transducers are working in unison, compresses the air therein in-phase while in operation. The size of the enclosure (hyperboloid) is determined mainly by the size and electro-mechanical specifications of the transducers or speakers. The minimum internal volume of the enclosure is determined by the electrical power to mechanical force conversion of the speakers. The speakers must be able to compress the air inside the enclosure up to the limit of cone travel, while staying within their electric power limit and linearity. The speakers act like piston compressing air within a closed cylinder. The air acts as a spring, alternately storing and releasing energy as the speakers move.

The speaker panels 24 may be formed of any number of suitable materials, including wood, metals and plastics. Certain plastics are desirable in that they lend themselves to vacuum forming or injection molding for ease and low cost manufacturing.

Among the advantages of the present system is that of having the widest possible frequency response getting the low frequency up as soon as possible, and staying flat over the whole frequency range. This phased array system creates and extends the hyperboloid cones by the pressure wave from adjacent speakers.

While I have illustrated and described my invention by means of specific embodiments, it is to be understood that numerous changes and modifications may be made therein without departing from the spirit and the scope of the invention as defined in the impending claims.

I claim:

1. A speaker system of a plurality of speakers housed in a single hemispherically directed array, comprising:

a housing having the configuration of a single hemisphere with a front, a back and a chamber, the back defined by a planar plate defining a plane, and the front defined by a plurality of horns, each horn equally spaced around and from one another in a single hemispherical array and directed outward from a common point on said plane; and each of said horns having an apex and a focal point, and a transducer of a first frequency range mounted at the apex thereof.

2. A system according to claim 1, wherein said horns each having a hyperboloid configuration and said horns are at least six in number.

3. A signal device according to claim 2 wherein said transducers are sealed in said housing.

4. A signal device according to claim 3 wherein each horn is a hyperboloid extension of intersecting adjacent extensions joined by means of curved edges thereof.

5. A signal device according to claim 4 wherein each of said horns is defined by a housing wall that extends to and merges with a wall of an adjacent horn at an angle of less than about 15 degrees at a curved edge.

6. A speaker system according to claim 5 wherein said plane is a surface of a musical instrument.

7. A speaker system according to claim 6 wherein a transducer of a higher frequency mounted at the focal point thereof.

8. A speaker system according to claim 5 wherein said plane is a surface of a wall of a room.

9. A speaker system according to claim 1 wherein said plane is a surface of a housing of a musical instrument.

10. A speaker system according to claim 9 wherein said musical instrument is a piano.

11. A speaker system according to claim 1 wherein said housing is sealed thereby sealing said transducers in said housing.

12. A speaker system according to claim 11, wherein said each horn is a hyperboloid extension of intersecting adjacent extensions by means of merged curved edges thereof.

13. A speaker system according to claim 11 wherein each of said horns define a housing wall that extends to and merges with a wall of an adjacent horn at an angle of less than about 15 degrees at a curved edge.

14. A speaker system according to claim 1 wherein each of said horns define a housing wall that extends to and merges with a wall of an adjacent horn at an angle of less than about 15 degrees at a curved edge.

15. A speaker system according to claim 14 wherein one of said horns has an axis extending normal to said plane.

16. A hemispherically directed speaker system, comprising:

a housing having the configuration of a single hemisphere, with a back defined by a planar plate defining a plane and a front defined by a plurality of at least six horns, each horn having a hyperboloid configuration with a central horn and a plurality of horns equally spaced around said central horn and from one another in a single hemispherical array and directed outward from a common point on said plane forming a sealed housing; and each of said horns having an apex and a focal point, and a transducer of a first frequency mounted at the apex thereof, and a transducer of a higher frequency mounted at the focal point thereof, each horn is defined by a housing wall that is a hyperboloid extension that extends to and merges with a wall of an adjacent horn at an angle of less than about 15 degrees at a curved edge.

17. A speaker system according to claim 16 wherein said plane is a surface of a housing of a musical instrument.

18. A speaker system according to claim 17 wherein said musical instrument is a piano.

19. A speaker system according to claim 16 wherein said plane is a surface of a wall of a room.

20. A speaker system according to claim 16 wherein said plane is a surface of a ceiling of a room.

* * * * *